United States Patent [19]

Hawes et al.

[11] 4,361,234

[45] Nov. 30, 1982

[54] TIERABLE AND NESTABLE CONTAINER

[75] Inventors: Daniel D. Hawes, Chagrin Falls; Edward W. Massey, Parma, both of Ohio

[73] Assignee: Bliss & Laughlin Industries Incorporated, Oak Brook, Ill.

[21] Appl. No.: 244,218

[22] Filed: Mar. 16, 1981

[51] Int. Cl.[3] ..... B65D 21/04

[52] U.S. Cl. ..... 206/505; 206/513; 220/19

[58] Field of Search ..... 206/505, 513; 220/19

[56] References Cited

U.S. PATENT DOCUMENTS

| | | | |
|---|---|---|---|
| 2,970,714 | 2/1961 | Glezen | 220/19 |
| 3,079,206 | 2/1963 | Glezen | 206/505 |
| 3,091,355 | 5/1963 | Mutta | 220/19 |
| 3,334,766 | 8/1967 | Rogus | 220/19 |
| 3,752,352 | 8/1973 | Senecal | 220/19 |

FOREIGN PATENT DOCUMENTS

| | | | |
|---|---|---|---|
| 920626 | 3/1963 | United Kingdom | 206/505 |

*Primary Examiner*—George E. Lowrance

*Attorney, Agent, or Firm*—Baldwin, Egan, Walling & Fetzer

[57] ABSTRACT

A container adapted to nest and tier with like containers, with the container having a bottom wall and side walls extending upwardly from the bottom wall and terminating in a top edge extending around the container, and with there being provided tiering means projecting laterally of the ends of the container for tiering the container on the top edge of a like container with at least a portion of the ends of the container being open, and with one container being adapted to be entered into the first container in a tilted position so that the tiering means on the entering container passes through one of the open ends and beneath the overlying upper edge of the receiving container, and then the entering container is moved generally vertically downwardly into nested relation into the receiving container.

6 Claims, 8 Drawing Figures

TIERABLE AND NESTABLE CONTAINER

This invention relates to improvements in a tierable and nestable container and more particularly to a container that is particularly adapted for domestic use, so that a plurality of the containers can be disposed in nested relation and when needed can be readily disposed in stable tierable condition for receiving products and packages therein, in conveniently stored condition.

BACKGROUND OF THE INVENTION

Nestable and tierable containers formed of wire are well known in the art. U.S. Pat. No. 3,334,766 issued Aug. 8, 1967 to J. A. Rogus is an example of such prior patent art. The present invention provides a nestable and tierable container which embodies laterally projecting tiering means formed with the container and in the embodiment illustrated preferably extending from the ends thereof for tiering one container onto another like container, and wherein such containers can be readily nested by tilting the entering container and passing it through the open end of the receiving container and then generally leveling the entering container while moving it generally vertically downwardly into nested relation with the first or receiving container. Thus a plurality of nested containers can be stored until needed and can be placed in tiered condition by reversing the latter described procedure. No rotation about a vertical axis of one container with respect to the underlying container is required to nest and/or tier the same.

Accordingly, an object of the present invention is to provide a container of the type described that includes tiering means thereon generally adjacent the bottom wall thereof and projecting laterally of the container, which provide for readily tiering one container onto a like container, and wherein the containers can be nested with respect to one another by tilting the entering container and moving it diagonally into the receiving container so that the tiering means passes through an open portion of the receiving container and then moving the entering container generally vertically into nested condition in the receiving container.

Another object of the invention is to provide a container of the above discussed type in which the tiering means comprises generally inverted V-shaped or hook shaped sections of the bottom wire members forming the bottom wall of the container, with the apexes of such inverted sections being disposed generally in a vertical plane in which the top edge of the overlying end section of the container is disposed.

Another object of the invention is to provide a container of the aforedescribed type which is convenient to manufacture and which will effectively hold a plurality of articles therein with the container being able to be mass produced.

Other objects and advantages of the present invention will be apparent from the following description taken in conjunction with the accompanying drawings wherein:

DESCRIPTION OF PREFERRED EMBODIMENT

Figures 1, 5, 6, 7, 8:
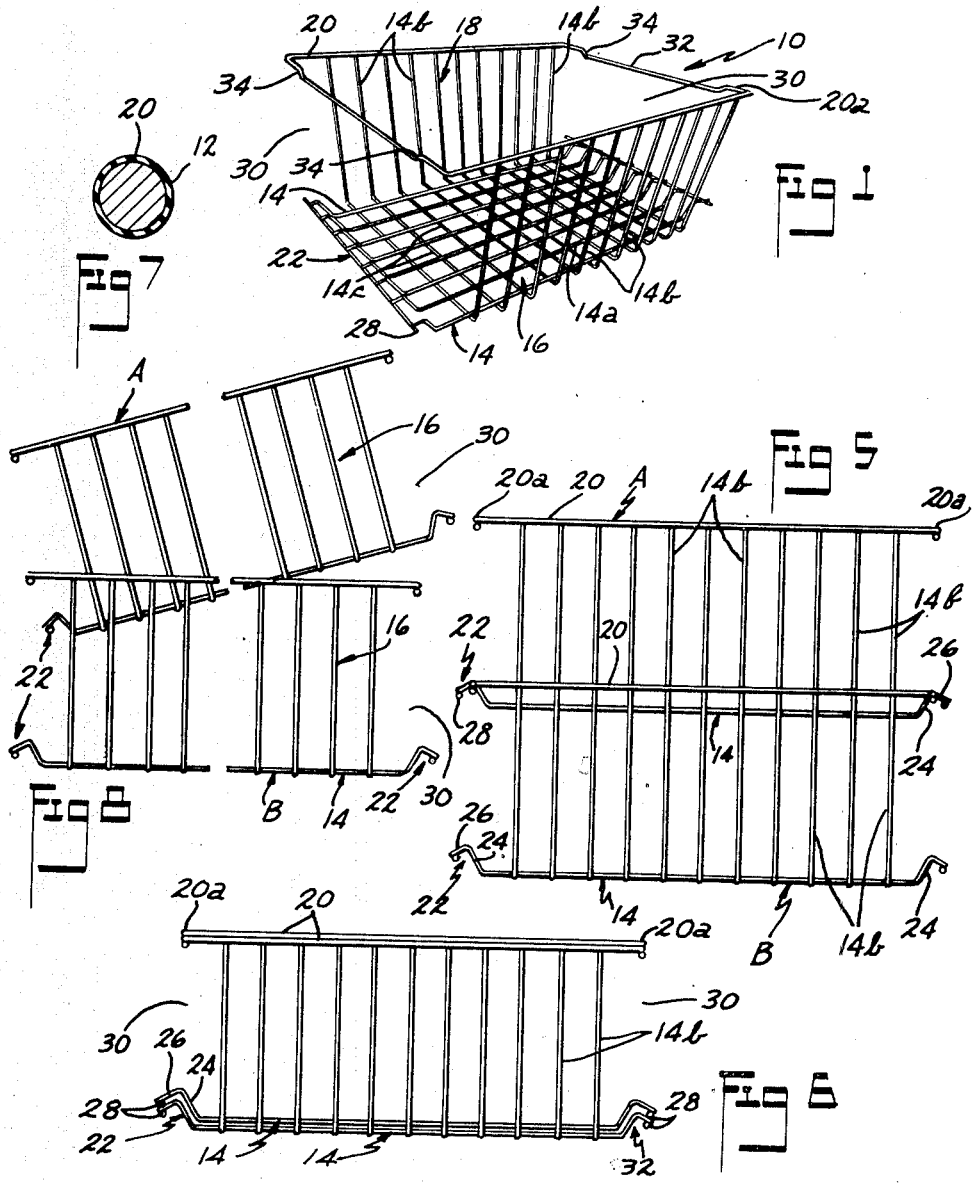
FIG. 1 is a perspective view of a container embodying the present invention and constructed of wire.
FIG. 5 is a side elevational view showing a container embodying the invention tiered on a like container.
FIG. 6 is a side elevational view showing one of the containers embodying the invention nested in a like container.
FIG. 7 is an enlarged, sectional view taken generally along the plane of line 7—7 of FIG. 4 looking in the direction of the arrows.
FIG. 8 is a broken, side elevational view illustrating the movement of a first or entering container relative to a lower or receiving container when moving from the tiering position of FIG. 5 into the nesting position of FIG. 6, or vice versa.

Referring now again to the drawings, there is illustrated a container 10 formed of wires, which may be welded to one another at their engaged crossing areas and which may be subsequently coated or covered with a layer of plastic material 12 (FIG. 7) in a manner known in the art.

The bottom wall 14 of the container is comprised of elongated wire members 14*a* running lengthwise of the container bottom wall and generally parallel to the side wall portions 16, 18 of the container, with the side wall portions extending upwardly from the bottom wall and terminating in a generally horizontal edge or rim 20 extending completely around the container.

Figure 4:
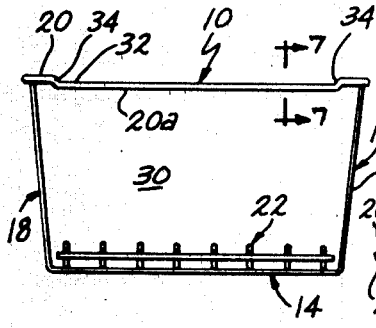
FIG. 4 is an end elevational view of the FIGS. 1, 2 and 3 container, illustrating the open ends of the container.
Figure 3:
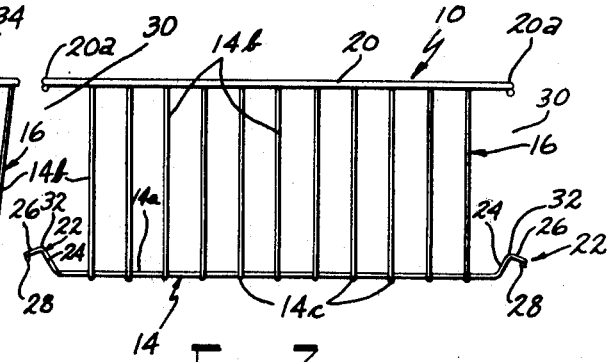
FIG. 3 is a side elevational view of the FIGS. 1 and 2 container.

Edge 20 is preferably formed of wire of a slightly greater cross-sectional dimension as compared to the wire forming the side and bottom walls of the container, and as can be best seen from FIGS. 3 and 4. The side walls 16, 18 are formed of wires 14*b* which may be attached as by welding to the upper edge 20 where they meet the latter, and which extend in generally parallel relation with respect to the other wires in the respective side wall, down to the bottom wall 14 of the container where they merge with the cross wires 14*c* of the bottom wall.

Figure 2:
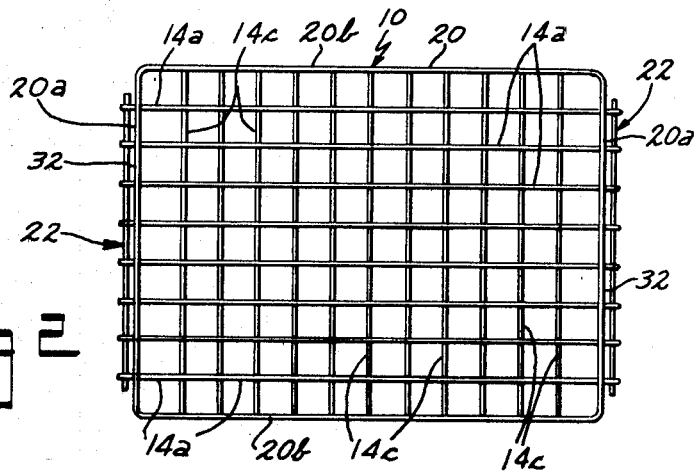
FIG. 2 is a top plan view of the container of FIG. 1.

The container 10 has tiering support means 22 projecting laterally from the ends thereof and generally beyond the vertical plane of the respective end sections 20*a* of the top edge 20 (FIGS. 2 and 3). In the embodiment illustrated, such tiering support means comprises bent sections of the distal ends of the wires 14*a* of the bottom wall 14 which sections are generally bent diagonally upwardly as at 24, and then diagonally downwardly as at 26 into a generally inverted V-shaped or hook form, as best illustrated for instance in FIG. 3. To the underside of such tiering means 22 may be connected an elongated member 28 comprising a wire secured as by welds, to the adjacent distal ends of the diagonally downwardly extending wire sections 26. At least a portion of the ends of the container are open as at 30, for a purpose to be hereinafter set forth.

The end sections 20*a* of the top edge 20 are recessed or bent downwardly as at 32. Such recessed section 32, as can be best seen in FIG. 2, has a greater length dimension as compared to the length dimension of the underlying inverted V-shaped tiering support section 22, so that when one container (e.g. A - FIG. 5) is tiered on an underlying similar container B, such recessed sections 32 of the upper edge of container B will receive therein the tiering sections 22 of container A to support container A on the underlying container B. Such recessed portions 32 also provide oblique shoulders 34 which limit lateral movement of the tiering means 22 and thus of the supported container A with respect to the underlying supporting container B.

Now to nest one container in an underlying or receiving container, the entering container A is preferably disposed in a generally tilted position about a generally horizontal axis, as shown for instance in FIG. 8, and then is moved generally diagonally downwardly so that the tiering means 22 on container A passes through the adjacent open end 30 of the underlying container B which will then provide sufficient clearance for the tiering means 22 on the opposite end of the entering container A to be received downwardly below the plane of the respective end section 20*a* of the top edge of container B, and then the entering container may be generally leveled and moved generally vertically downwardly until engagement between elongated stop member 28 on the tiering support means of container A and the underlying tiering means 22 on the receiving container B occurs, at which time the containers A and B are nested in compact condition with respect to one another. In such condition, the recessed portions 32 of container A are generally received in the respective recessed portion of container B, as shown in FIG. 6. To tier the containers, the reversal of the aforementioned operation is all that is required.

It will be noted that the length of stop member 28 on the respective tiering support means is such that it can pass into the receiving container past the side edge portions 20*b* of the top edge thereof without interference, and it will also be noted that the apex 26 (FIG. 3) of the tiering means 22 on a container is generally aligned in a vertical plane containing the end section 20*a* of the top edge 20 of the container.

The diagonally upwardly bent section 24 of the tiering means 22 on a container is preferably disposed at an angle of approximately 60° with respect to the horizontal, and the diagonally downwardly bent section 26 of the tiering means is preferably disposed at an angle of approximately 20° with respect to the horizontal, with said sections meeting in a generally smooth curve to form the aforementioned apex of the respective inverted V or hook section. It will be noted that the inverted V sections provide for securely tiering one container with a similar container, with the elongated member 28 aiding in limiting inadvertent lengthwise movement of a tiered container (e.g. A) with respect to the underlying container (e.g. B), and providing a limiting stop for any such movement, while the aforementioned shoulders 34 provide stops for lateral movement of the tiered container with respect to the underlying supporting container.

From the foregoing discussion and the accompanying drawings it will be seen that the invention provides a novel container for tiering and nesting with other like containers, and one that includes tiering means projecting laterally from the ends of the container and wherein an entering container can be readily received into a like receiving container, by tilting the entering container and moving it through the open end of the receiving container, and then generally vertically down into nested condition. The invention also provides a container that is particularly adapted for domestic use for storing a plurality of packages or products, and one that can be conveniently mass produced.

The terms and expressions which have been used are used as terms of description and not of limitation, and there is no intention, in the use of such terms and expressions of excluding any equivalents of any of the features shown or described, or portions thereof, and it is recognized that various modifications are possible within the scope of the invention claimed.

What is claimed is:

1. A container formed of wire and adapted for tiering and nesting with other like containers, said container having bottom wall means and diverging side wall means extending upwardly from said bottom wall means, and terminating in a generally horizontal substantially rectangular shaped in plan, top edge member extending around the container, means generally adjacent said bottom wall means and formed integrally therewith for tiering said container on a top edge member of a like container, the last mentioned means projecting laterally of a vertical plane in which the respective end section of said top edge member is disposed, said container including ends which are open and nonobstructed in the areas beneath said end sections of said edge member, another like container being adapted to be nested in said first container by entering the other container into the open top of said first container in a tilted position, so that the tiering means of the entering container may pass through said open area of one end of the first container and through said plane and beneath said respective end section of said edge member of said first container, and then the entering container may be moved generally vertically to cause the entering container to nest into the first or receiving container, said end sections of said top edge member each including an intermediate portion which is recessed downwardly with respect to the horizontal plane of the side sections of said top edge member, said bottom wall means comprising a plurality of elongated spaced wire members extending generally parallel to said side wall means, the distal ends of at least certain of said wire members being bent diagonally upwardly and then diagonally downwardly to form a generally inverted V-shape providing said tiering means, said side wall means being comprised of spaced generally vertically extending wire members which are connected into pairs at their lower ends by transversely extending wire sections, crossing said bottom wall wire members, and being secured thereto at areas of engagement, said recessed portions of said end sections of said top edge member being adapted to receive said tiering means of an overlying tiered container, and providing spaced shoulders on said edge member end sections for limiting lateral movement of a tiered container with respect to the supporting container, and wherein said tiering means on each end of said container includes means providing an abutment stop, said stop comprising an elongated linear member having opposite terminal ends and disposed closely adjacent the distal ends of said diagonally extending downwardly directed sections of said tiering means, and secured thereto on the under sides thereof, and providing the sole interconnection of the inverted V-shaped tiering means together on the respective end of the container, said elongated stop member extending generally in a direction transverse of the direction of extension of said wire members of said bottom wall means, and generally parallel to said transversely extending connecting wire sections of said paired side wall wire members, the apexes of said tiering means being generally disposed in a vertical plane containing the overlying respective end section of said top edge member, and each said elongated stop member being of a lesser length as compared to the transverse distance between said side sections of said top edge member, and of a length providing for said nesting of said container without interference between said stop member and the side wall means of the receiving container.

2. A container in accordance with claim 1 wherein said wires are coated with a plastic.

3. A container in accordance with claim 1 wherein said diagonally upwardly bent section of said tiering means is disposed at an angle of approximately 60° with respect to the horizontal and said diagonally downwardly bent section of said tiering means is disposed at an angle of approximately 20° with respect to the horizontal, with said sections meeting in a generally smooth curve forming the apex of the respective inverted V-shape.

4. A container in accordance with claim 1 wherein said recessed portion is recessed vertically a dimension approximately the same as the cross-sectional dimension of said top edge member.

5. A container in accordance with claim 1 wherein the cross-section dimension of said top edge member is greater than the cross-sectional dimension of one of said wires of said bottom and said side wall means.

6. A container in accordance with claim 3 wherein said upwardly bent section of each said V-shape of said tiering means is of a greater lengthwise dimension as compared to the lengthwise dimension of the associated downwardly bent section, whereby the free distal ends of said downwardly bent sections of said tiering means are disposed above a horizontal plane passing through said wire members of said bottom wall means.

* * * * *